US009895817B2

(12) United States Patent
Georgakis et al.

(10) Patent No.: US 9,895,817 B2
(45) Date of Patent: Feb. 20, 2018

(54) SHAVER

(71) Applicant: BIC-VIOLEX SA, Anixi, Attiki (GR)

(72) Inventors: Georgios Georgakis, Melissia (GR); Panagiotis Zafiropoulos, Wallingford, CT (US)

(73) Assignee: BIC VIOLEX S.A., Anixi (GR)

( * ) Notice: Subject to any disclaimer, the term of this patent is extended or adjusted under 35 U.S.C. 154(b) by 274 days.

(21) Appl. No.: 14/650,410

(22) PCT Filed: Dec. 21, 2012

(86) PCT No.: PCT/EP2012/076805
§ 371 (c)(1),
(2) Date: Jun. 8, 2015

(87) PCT Pub. No.: WO2014/094908
PCT Pub. Date: Jun. 26, 2014

(65) Prior Publication Data
US 2015/0306777 A1 Oct. 29, 2015

(51) Int. Cl.
*B26B 21/52* (2006.01)
*B26B 21/14* (2006.01)
*B26B 21/22* (2006.01)

(52) U.S. Cl.
CPC ..... *B26B 21/521* (2013.01); *B26B 21/14* (2013.01); *B26B 21/222* (2013.01); *B26B 21/225* (2013.01); *B26B 21/227* (2013.01)

(58) Field of Classification Search
CPC ..... B26B 21/521; B26B 21/14; B26B 21/222; B26B 21/227; B26B 21/225; B26B 21/40; B26B 21/52; B26B 21/4012
USPC ..... 30/50, 527, 32, 526, 57, 74
See application file for complete search history.

(56) References Cited

U.S. PATENT DOCUMENTS

| | | | | |
|---|---|---|---|---|
| 7,200,942 | B2 * | 4/2007 | Richard | B26B 21/225 30/526 |
| 2006/0242847 | A1 * | 11/2006 | Dansreau | B26B 21/38 30/526 |
| 2006/0260131 | A1 * | 11/2006 | Follo | B26B 21/225 30/50 |
| 2010/0071214 | A1 * | 3/2010 | Kinghorn | B26B 21/42 30/30 |
| 2011/0016724 | A1 | 1/2011 | Murgida | |

(Continued)

FOREIGN PATENT DOCUMENTS

| | | | |
|---|---|---|---|
| EP | 1 935 588 | A1 | 6/2008 |
| GB | 2471676 | A | 1/2011 |
| WO | WO 2010/078564 | A2 | 7/2010 |

OTHER PUBLICATIONS

International Report of PCT/EP2012/076805 dated Sep. 10, 2013.

*Primary Examiner* — Ghassem Alie
(74) *Attorney, Agent, or Firm* — Polsinelli PC

(57) ABSTRACT

A shaver that includes a handle with an elongated handgrip portion and a mounting portion, and a shaver head attached to the mounting portion. A removable cartridge is attached to the shaver head through a rotating lock. The rotating lock is adapted to rotate about an axis parallel to the length of the blades of the cartridge, thus defining a neutral position and a rotated position. The rotating lock in the neutral position attaches the cartridge to the shaver head, and the rotating lock in the rotated position releases the cartridge from the shaver head.

19 Claims, 7 Drawing Sheets

(56) References Cited

U.S. PATENT DOCUMENTS

2014/0109735 A1* 4/2014 Shepperson ..... B26B 21/521
83/13

* cited by examiner

SHAVER

This application is a national stage application of International Application No. PCT/EP2012/076805, filed on Dec. 21, 2012, the entire contents of which are incorporated herein by reference.

FIELD OF INVENTION

The embodiment of the present invention relates to a shaver with interchangeable cartridges, and to cartridges and head and handle assembly for such a shaver.

More particularly, the embodiments of the present invention relate to a shaver that includes:

a handle with an elongated body terminating in a mounting portion for retaining a shaver head, a shaver head adapted to accommodate an interchangeable shaving cartridge, a lock-and-release mechanism to enable the interchangeable shaving cartridge to be loaded and ejected from the shaver head, and an interchangeable cartridge containing one or more blades.

Such a shaver enables the user to replace the cartridge once the blade or blades become worn, while the handle and the shaver head can be kept and reused.

BACKGROUND OF THE INVENTION

The removal from the shaver head of the interchangeable blade cartridges, such as those disclosed in e.g. EP2195145, usually requires the user to press or pull the cartridge to actually displace the cartridge. This means that to replace the cartridge, the user needs to encounter the cartridge by his/her fingers. Therefore, the risk of the injury of the user is increased.

SUMMARY OF THE INVENTION

A shaver is provided, the shaver that includes a handle with an elongated handgrip portion and a mounting portion, a shaver head, the shaver head being attached to the mounting portion, a removable cartridge, the cartridge comprising at least one blade, the at least one blade having a length, the cartridge being adapted to be attached to the shaver head and removed from the shaver head, a rotating lock provided on the shaver head, the rotating lock being adapted to removably attach the cartridge to the shaver head, wherein the rotating lock is adapted to rotate about an axis parallel to the length of the at least one blade, thus defining a neutral position and a rotated position, wherein the rotating lock in the neutral position attaches the cartridge to the shaver head, and the rotating lock in the rotated position releases the cartridge from the shaver head.

In some embodiments, one may also use one or more of the following features:

the shaver head may be attached pivotally to the mounting portion, the shaver head further comprises a bottom part, and the rotating lock is provided in the bottom part, the shaver head further comprises a pair of holding pegs, and the holding pegs facilitate the rotation of the rotating lock, the cartridge is ejected in a direction parallel to the direction of shaving, the rotating lock is provided as a rotating bar, the rotating lock comprises an elongated body, at least one projection, protruding in a direction away from the shaving plane, a pair of cavities positioned at the ends of the elongated body and being adapted to attach the rotating lock to the haver head, and at least one retention cavity, the rotating lock comprises an elongated body, a pair of projections, protruding in a direction away from the shaving plane, a pair of cavities positioned at the ends of the elongated body and being adapted to attach the rotating lock to the haver head, and a pair of retention cavities, the shaver head further comprises a return spring, the return spring being adapted to return the rotating lock to the neutral position, the shaver head further comprises at least one ejection button, the ejection button being adapted to eject the cartridge from the shaver head, the shaver head further comprises at least one ejection spring, the ejection spring cooperating with the at least one ejection button, the handle further comprises a slidable button, the button that includes a pusher, the pusher being adapted to encounter the projections of the rotating lock and thus release the cartridge, the cartridge further comprises a holder, and the retention cavities of the rotating lock and the holder cooperate to attach the cartridge to the shaver head, the shaver head further comprises lateral walls, the lateral walls comprise guide tracks, the cartridge further comprises lateral walls, the lateral walls comprise guide tracks, and the guide tracks of the cartridge are adapted to cooperate with guide tracks of the shaver head.

In another aspect of the present invention, a cartridge is provided, the cartridge comprising a holder, and the holder takes a form of at least one hook.

In some embodiments, one may use one or more of the following features:

the cartridge comprises at least one blade, the at least one blade is mounted movably, the cartridge further comprises a top wall and a shaving aid, the shaving aid being positioned in the top wall.

In yet another aspect of the present invention, a head and handle assembly for a shaver is provided, the head and handle assembly that includes a handle with an elongated handgrip portion and a mounting portion, a shaver head, the shaver head being adapted to receive a cartridge, the shaver head being attached to the mounting portion, a rotating lock provided on the shaver head, the rotating lock being adapted to removably attach the cartridge to the shaver head, wherein the rotating lock is adapted to rotate about an axis parallel to the length of the at least one blade, thus defining a neutral position and a rotated position, wherein the rotating lock in the neutral position is adapted to attach the cartridge to the shaver head, and the rotating lock in the rotated position is adapted to release the cartridge from the shaver head.

In some embodiments, one may also use one or more of the following features:

the shaver head may be attached pivotally to the mounting portion, the shaver head further comprises a bottom part, and the rotating lock is provided in the bottom part, the rotating lock comprises an elongated body, at least one projection, protruding in a direction away from the shaving plane, a pair of cavities positioned at the ends of the elongated body and being adapted to attach the rotating lock to the haver head, and at least one retention cavity, the handle further comprises a slidable button, the button that includes a pusher, the pusher being adapted to encounter the projections of the rotating lock and thus release the cartridge.

With these features, when the cartridge is to be removed from the shaver head, it is more easily ejected from the shaver head. The user does not have to push or pull the cartridge and the risk of injury of the user is lowered. Moreover, as only the cartridge is replaced when the blades become worn, instead of replacing the whole shaver head, the costs of such shaver are kept lower. Further, as only the cartridge is replaced, the shaver is both easier to manufacture and more environment friendly, as the amount of material to be replaced (and disposed of) is reduced.

BRIEF DESCRIPTION OF THE DRAWINGS

Other characteristics and advantages of the invention will readily appear from the following description of one of its embodiments, provided as a non-limitative examples, and of the accompanying drawings.

On the drawings.

DETAILED DESCRIPTION

Figure 1A:
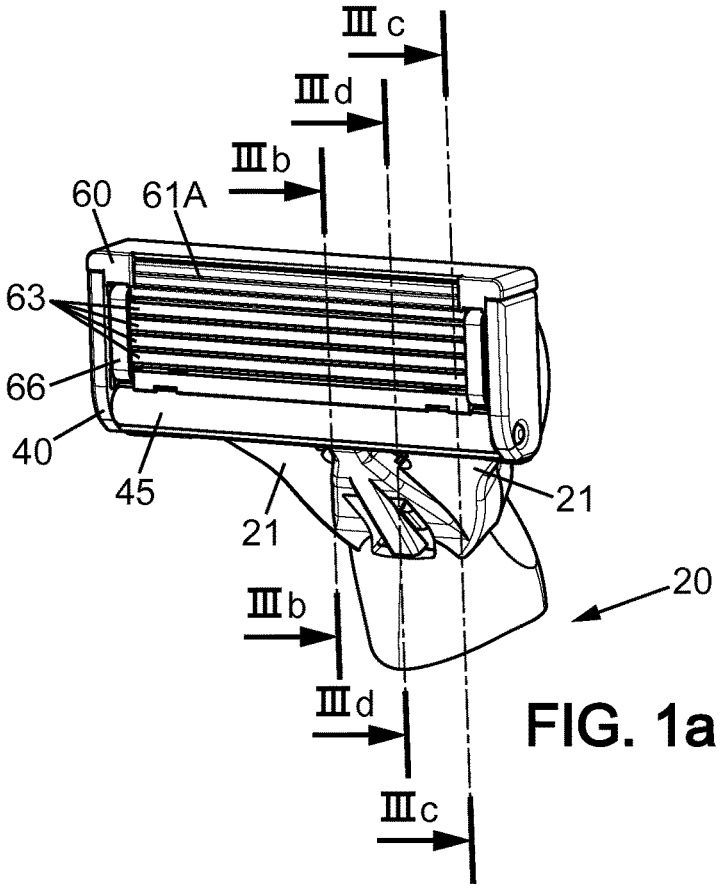
FIG. 1*a* shows an overall view of the shaver from the front side
Figure 1B:
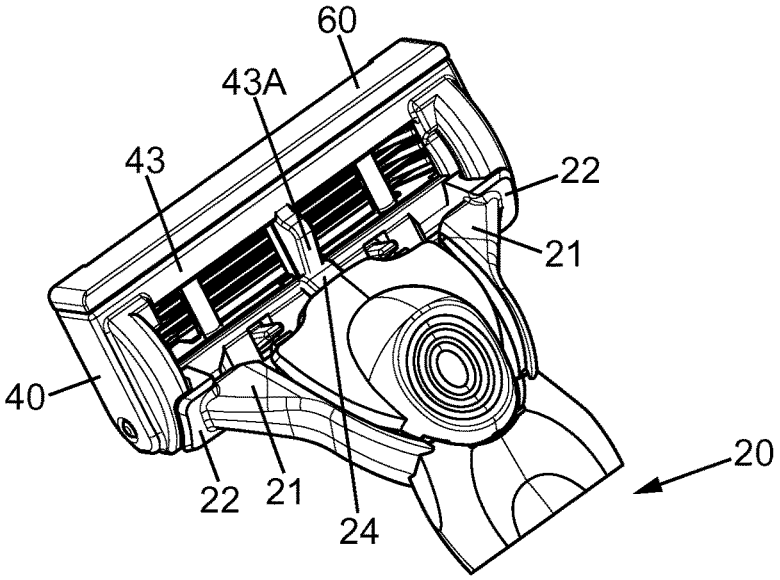
FIG. 1*b* shows an overall view of the shaver from the back side

FIGS. 1*a* and 1*b* show an example of a shaver according to the present invention. The shaver comprises a handle 20, a shaver head 40 and a cartridge 60, which accommodates one or more blades 63. On the example shown on the Figures, there are four blades. However, the cartridge may also use more or less of blades.

Figure 5:
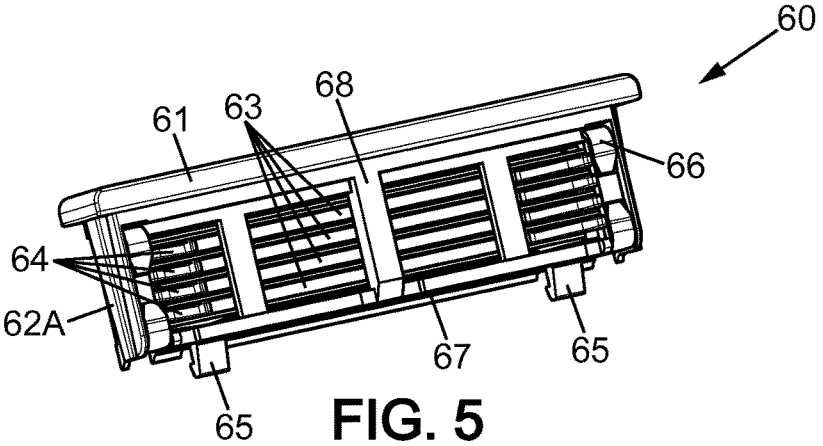
FIG. 5 is a back view of the cartridge
Figure 6A:
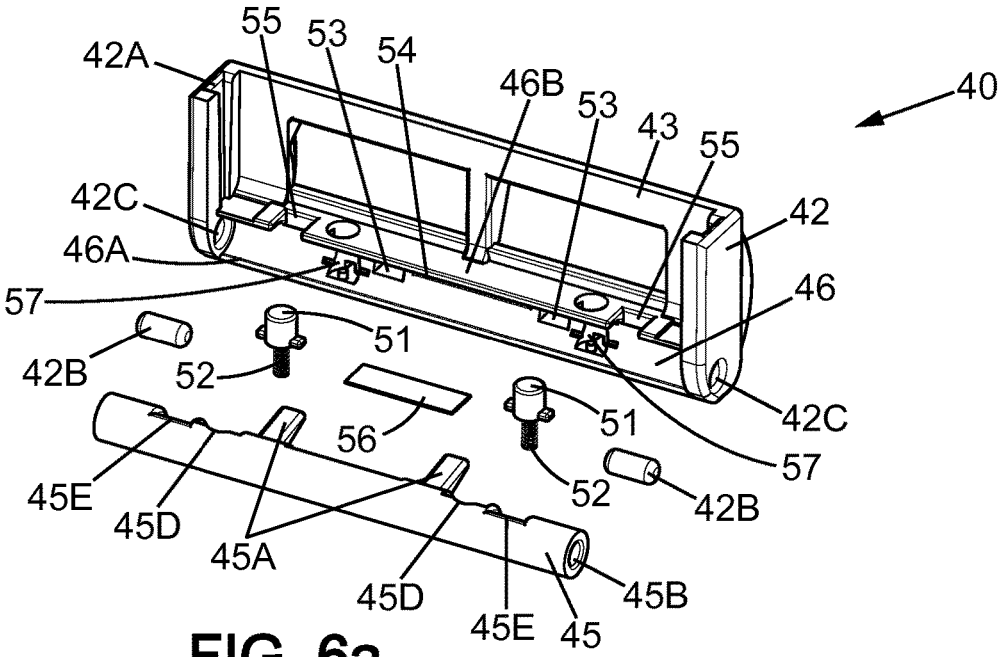
FIG. 6*a* shows an exploded view of the shaver head
Figure 6B:
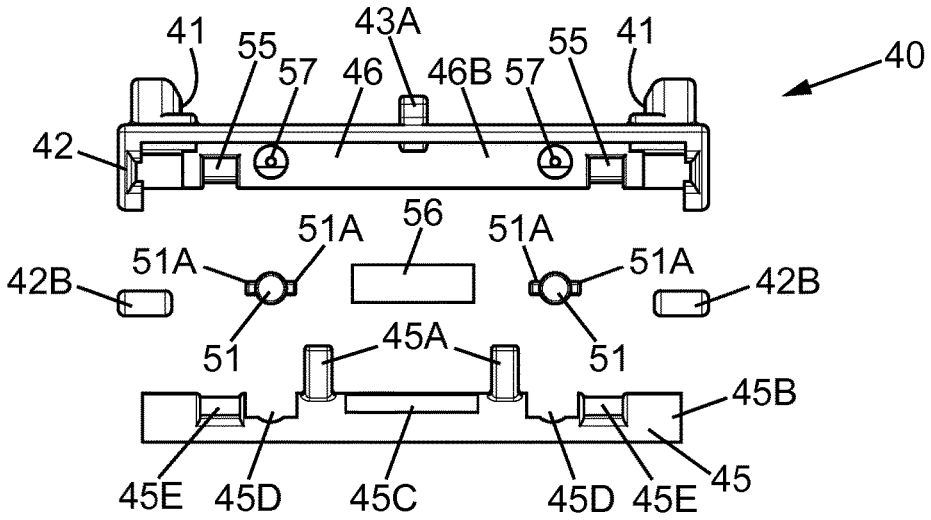
FIG. 6*b* shows an exploded view of the shaver head

The cartridge 60 (shown on FIGS. 3*a* and 5) is formed as a frame with a top wall 61, two lateral walls 62, bottom wall 67 and a back structure 68 (shown in detail on FIG. 5). The top wall 61 and the bottom wall 67 are elongated and connected by the lateral walls 62. The frame of the cartridge 60 may be molded out of plastic; preferably, the frame is one-piece. The blades 63 extend between the lateral walls 62, parallel to the top wall 61 and the bottom wall 67. The blades 63 may be made from bent sheet metal, or, preferably, they may be straight and supported with blade supports (not shown). The blades 63 and/or the blade supports 63A are then accommodated in seats (not shown) provided in the lateral walls 62. Moreover, the blades may for instance be placed movably. The lateral walls 62 may be provided with elastic fingers 64, extending towards the insides of the cartridge frame, in a direction parallel to the blades 63, and supporting movably the blades 63. The blades 63 may be held in the cartridge by a pair of bent metal strips 66, which encircle the ends of the blades 63 and thus hold them in place. In the top wall 61, lying generally in a plane defined by the blade edges, a shaving aid 61A may be provided. In other embodiments, the blades may be fixed.

Figure 2A:
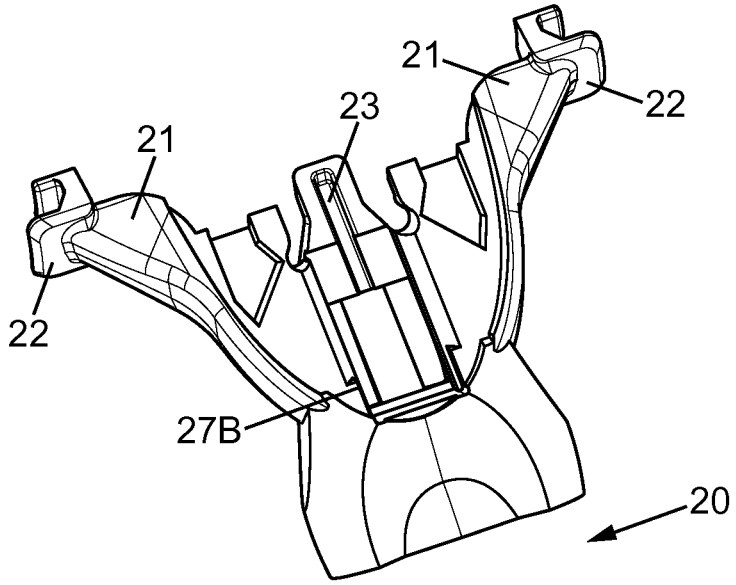
FIG. 2*a* shows a front portion of the handle
Figure 2B:
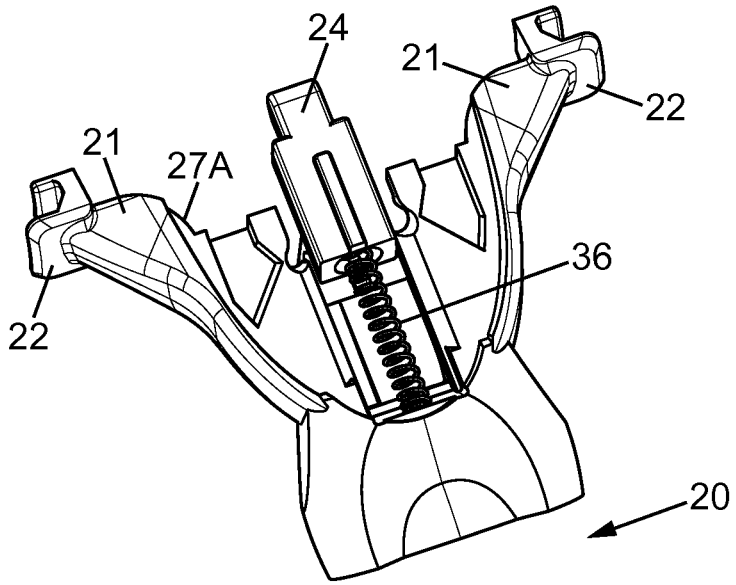
FIG. 2*b* shows a front portion of the handle with a cam follower and a spring

The handle 20 has an elongated handgrip portion (not shown) which may be provided with features that enhance grip of the user and help prevent slipping, such as ribs, pegs, elastomeric parts and the like. The handle 20 is preferably molded out of a plastic material. The handle 20 is terminated in two yokes 21 extending from the handle, as shown on FIG. 2. The yokes 21 end in a mounting portion, which may be provided in a form of shell bearings 22. The shell bearings 22 then cooperate with complementary depressions 41 provided on the shaver head 40. The shell bearings 22 and the complementary depressions 41 together enable the shaver head 40 to pivot about an axis parallel to the length of the blades 63. Alternatively, the shell bearings 22 may be replaced by hinges, pins or other pivoting means; the shaver head 40 may also be attached to the handle 20 without any pivoting means. Here, only the pivoting head will be described.

The yokes 21 further define a gap 23, positioned between the yokes 21. The gap 23 accommodates a cam follower 24. The cam follower 24 has a bifurcated end; the two branches cooperate with a rest 43A provided on back wall 43 of the shaver head 40, therefore enabling the shaver head 40 to be returned to the neutral position. The cam follower 24 is operated by a coil spring 36, which is preferably made of metal.

An example of a shaver head 40 is shown on FIGS. 3*a* to 3*d*, FIGS. 4*a* to 4*e* and FIGS. 6*a* and 6*b*. The shaver head comprises a back wall 43, a bottom part 46 and lateral walls 42. The front wall 42 may include a skin engaging element or a guard (not shown), preferably made in an elastomeric material. The back wall 43 comprises depressions 41, which accommodate shell bearings 22, positioned at the end of the handle 20. On the back wall 43, there is also a rest 43A, cooperating with the cam follower 24.

Figure 3A:
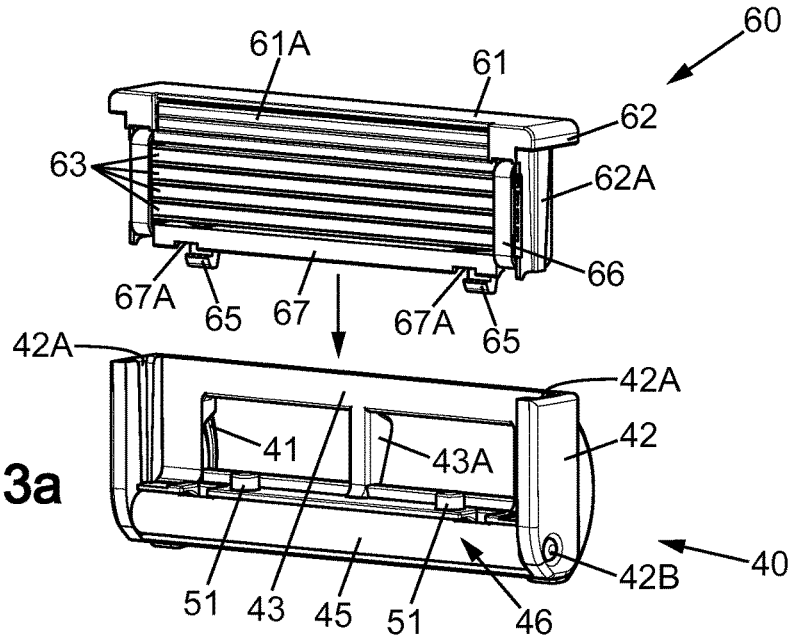
FIG. 3*a* shows a front view of a cartridge and a shaver head upon the insertion of the cartridge
Figure 4A:
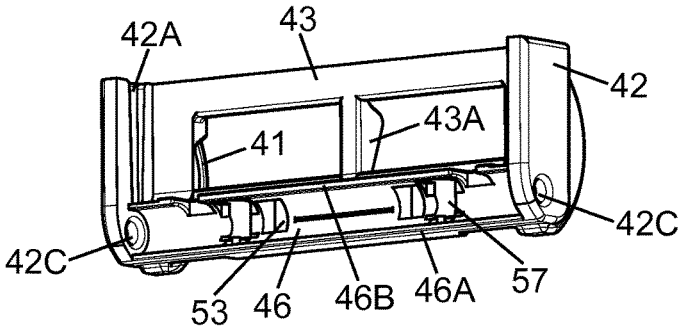
FIG. 4*a* shows the shaver head without the cartridge and without movable components, as seen from the front
Figure 4B:
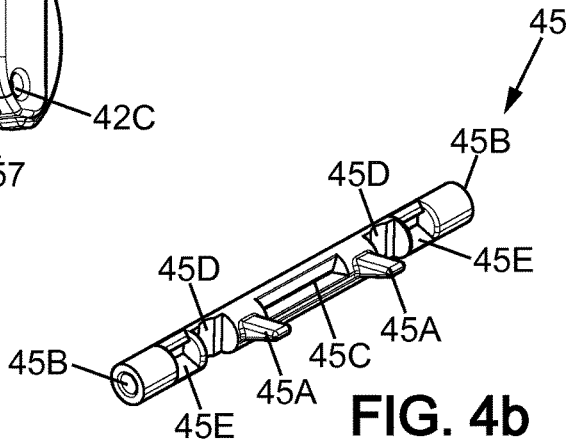
FIG. 4*b* shows a detail of a rotating lock
Figure 4C:
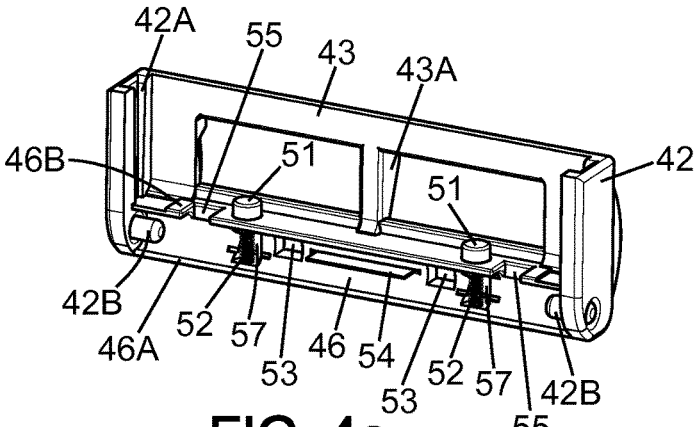
FIG. 4*c* shows the shaver head without the rotating lock, as seen from the front
Figure 3B:
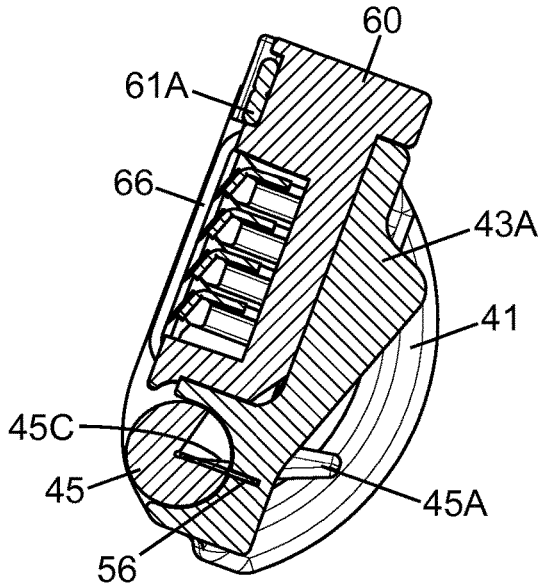
FIG. 3*b* shows a cross-section of the shaver head through a return spring, along line Ib
Figure 3C:
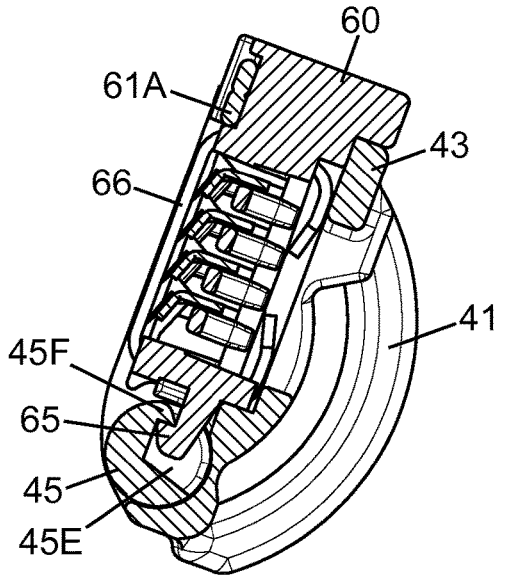
FIG. 3*c* shows a cross-section of the shaver head through the features attaching the cartridge to the shaver head, along line Ic
Figure 3D:
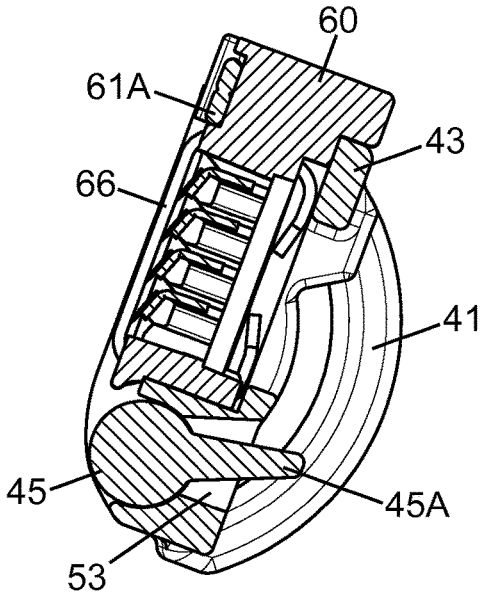
FIG. 3*d* shows a cross-section of the shaver head through projections provided on a rotating bar, along line Id
Figure 4D:
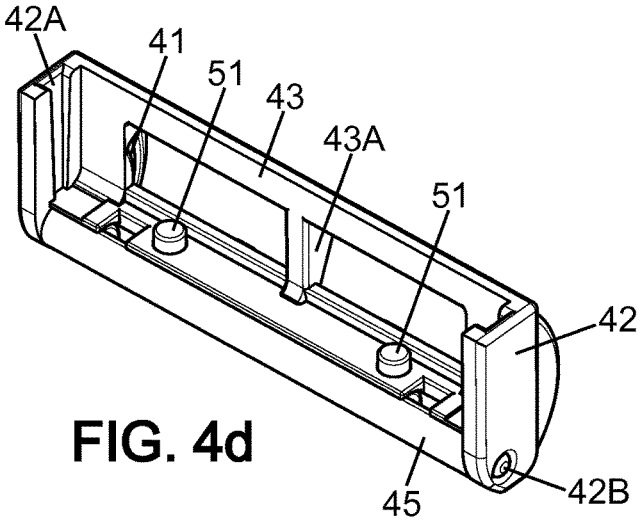
FIG. 4*d* shows the shaver head when assembled, as seen from the front
Figure 4E:
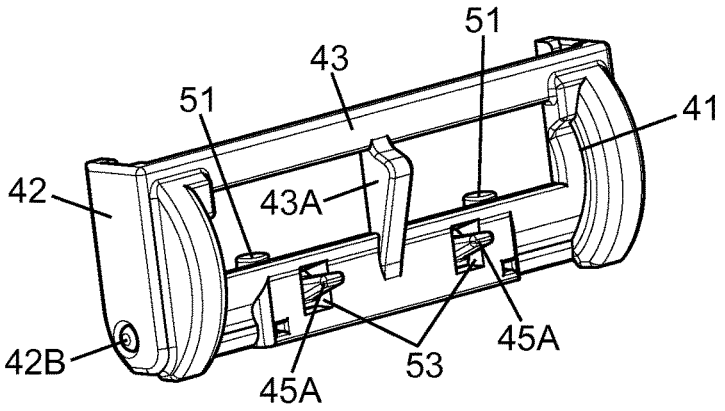
FIG. 4*e* shows the shaver head when assembled, as seen from the back

The shaver head 40 forms a seating where the cartridge 60 can be accommodated (detail of such seating is shown on FIGS. 3*a* and 4*d*). The cartridge 60 is preferably inserted from the side opposing the bottom part 46, as shown on FIG. 3*a*, generally in a direction of shaving. The lateral walls 42 include guide tracks 42A, formed as grooves on the insides of the lateral walls 42. Once the cartridge 60 is inserted into the shaver head, the guide tracks 42A are encountered by guide tracks 62A provided as protrusions on the lateral walls 62 of the cartridge 60 and the cartridge 60 is guided to its seating. The risk of wrong insertion of the cartridge 60 is thus lowered.

The bottom part 46 of the shaver head 40 is positioned between a bottom wall 46A and a seating wall 46B. The bottom part 46 comprises a holding mechanism, adapted to attach the cartridge 60 to the shaver head 40. The holding mechanism loads, retains, and ejects the cartridge 60. The mechanism preferably comprises a rotating lock 45 and a pair of holding pegs 42B. The rotating lock 45 may be provided behind the shaving guard (variant not shown), or may itself constitute at least part of the shaving guard. In the example shown in the Figures, the rotating lock is provided as a one-piece rotating bar, which may serve as a guard bar. However, there are other possibilities. The rotating lock, when in the form of a rotating bar serving as a guide bar, may be provided for example as a co-injection component which bears fins. The rotating lock may also be provided in more than one piece. The rotating lock may be rotating as a solid body about a rotating axis. The rotating lock may also perform a torsional movement, where only a part of the rotating bar is actually rotated.

The mechanism may also comprise at least one ejection button 51, at least one ejection spring 52, and at least one return spring 56. The bottom part 46 may further comprise a slot 54, accommodating the return spring 56. The bottom part 46 preferably further comprises a number of cavities 57, accommodating the ejection buttons 51 and the ejection springs 52; the number of cavities 57 preferably corresponds to the number of ejection buttons 51 and ejection springs 52. The seating wall 46B preferably comprises at least one seating slot 55. The bottom part 46 preferably further comprises at least one back opening 53.

In an example shown on FIGS. 3*b* to 3*d*, 4*a* to 4*e*, 6*a* and 6*b*, the holding mechanism comprises a pair of ejection buttons 51, a pair of ejection springs 52, one return spring 56, a pair of seating slots 55, and a pair of back openings 53. The ejection springs 52 are provided in a form of coil springs, but alternatively may be replaced by leaf springs or else. The return spring 56 is provided as a leaf spring. The return spring 56 may be also provided in a form of one or more helical or rotational springs or else.

In the bottom part of the lateral walls 42 of the shaver head, adjacent the bottom part 46 of the shaver head 40, a pair of openings 42C is positioned. The openings 42C are preferably circular and aligned so as to form an axis parallel with the bottom wall 46 of the shaver head. The axis is also parallel to the length of the blades, and parallel to the pivoting axis. In each of the openings 52C, a holding peg 42B is provided. The holding pegs 42B preferably take an overall shape of a cylinder, with a circular base. The holding pegs 42B can also take any other suitable shape that allows axial rotation, such as projections with a base in a shape of a square, a rectangle, a triangle or the like. The holding pegs 42C protrude towards insides of the bottom part of the shaver head 40, in a direction of the axis defined by the openings 42C; preferably, the holding pegs 42C are not protruding towards outsides of the shaver head 40, i.e. above the planes defined by the outer border of the lateral walls 42 of the shaver head 40. The holding pegs 42C are preferably made of plastic. The holding pegs 42C may also be made of metal.

From the seating wall 46B protrude a pair of ejection buttons 51. The ejection buttons are accommodated in corresponding cavities 57, provided in the bottom part 46 of the shaver head. The buttons 51 (as seen on FIGS. 6*a* and 6*b*) are generally cylinder shaped. The end protruding from the seating wall 46B is preferably closed. The part adjacent the bottom wall 46A is opened. Inside the ejection buttons 51, a cavity is formed. The cavity accommodates the coil spring 52. The coil springs 52 are attached to the bottom wall 46A. The coil springs 52 provide the ejection buttons 51 with a return force. The part of the ejection buttons 51 which is adjacent the bottom wall 46A could be provided with a pair of projections 51A, protruding generally in a direction towards the lateral walls 42 of the shaver head 40. The projections 51A help to center the ejection buttons 51 in their position. They also help to prevent accidental twisting of the ejection buttons 51 and the coil springs 52, thus helping in preventing overload and subsequent damage of the coil spring 52. The ejection buttons 51 are preferably made of plastic. The coil springs 52 are preferably made of metal.

The seating wall 46B further comprises seating slots 55. The slots 55 are provided preferably adjacent the ejection buttons 51. Once the cartridge 60 is inserted into the shaver head 40, the retention features 65 provided on the cartridge 60 go through the seating slots 55 and are retained by the rotating bar 45, as will be explained later.

The bottom part 46 of the shaver head 40 further comprises back openings 53. The back openings 53 go through the back wall 43 of the shaver head 40.

Preferably, the ejection buttons 51, the seating slots 55, and the back openings 53 are positioned symmetrically with respect to a plane perpendicular to the shaving plane defined by the blades 63.

The bottom part 46 of the shaver head 40 further comprises a slot 54. Preferably, the slot 54 is positioned between the back openings 53. Into the slot 54, the leaf spring 56 is inserted. The leaf spring 56 is inserted only partly, so that the leaf spring 56 protrudes from the slot 54 towards the insides of the shaver head 40. The leaf spring 56 (seen on FIGS. 6*a* and 6*b*) takes a form of a rectangle. The leaf spring 56 is preferably made of metal, but may be also made in any suitable material, such as plastic or material with elastic properties.

The bottom part 46 of the shaver head further comprises a rotating bar 45. In an example of a rotating bar 45 shown on FIG. 4*b*, the rotating bar 45 takes an overall shape of an elongated cylindrical body. Alternatively, instead of the elongated body being cylindrical, it can also be provided in a form of an elongated body with a cross section being triangular, rectangular, elliptical or the like.

At each end of the elongated body, there is a cavity 45B, adapted to accommodate one of the holding pegs 42B. The holding pegs 42B then hold the rotating bar 45 inside the bottom part 46 of the shaver head 40, and also facilitate rotation of the rotating bar 45. The axis defined by the holding pegs 42B then becomes the axis of the rotation of the rotating bar 45.

Preferably in the middle part of the rotating bar 45, a cavity 45C is provided. The cavity 45C takes an overall shape of a wedge, spanning along approximately one fourth to one third of the length of the rotating bar 45. The vertex of the cavity 45C cooperates with the leaf spring 56. When the leaf spring 56 is inserted, it connects the rotating bar 45 and the bottom part 46 of the shaver head 40. When the rotating bar 45 is rotated from a neutral position, the leaf spring 56 finds itself under tension and thus the leaf spring 56 returns the rotating bar 45 to its neutral position.

The rotating bar 45 is provided with at least one projection 45A. Preferably, there is a pair of projections 45A. The projections 45A are preferably located adjacent the cavity 45C. The projections 45A have preferably at least one flat surface. The projections 45A are inserted into the back openings 53 and protrude above a plane defined by the back wall 43. The back openings 53 are so wide as to enable movements of the projections 45A, generally in a direction parallel with the direction of shaving. The number of openings 53 thus preferably corresponds to the number of the projections 45A.

The rotating bar 45 further comprises at least one depression 45D. The number of depressions 45D preferably corresponds to the number of the ejection buttons 51. Preferably, there is a pair of depressions 45D. The depressions 45D are adapted to accommodate the ejection buttons 51 and the coil springs 52. The depressions 45D preferably take such a shape that the ejection buttons 51, when provided with the projections 51A, are prevented from turning and twisting.

The rotating bar 45 is further provided with at least one retention cavity 45E. The number of retention cavities corresponds to the number of seating slots 55. Preferably, there is a pair of retention cavities 45E. The retention cavities 45E are positioned so as to be aligned with the seating slots 55. The parts of the retention cavities 45E which are positioned adjacent the seating wall 46B are provided with a retention portion 45F. The retention portion 45F may take a part of a small hook compatible with the retention features 65 on the cartridge 60.

The cartridge 60 comprises a bottom wall 67, which further comprises retention features 65. In an example shown on FIGS. 3*a* and 5, the retention features form a pair of hooks 65, protruding downwardly from the bottom wall 67. Generally, the number of hooks 65 correspond to the number of seating slots 55 provided in the seating wall 46B of the shaver head 40, and also to the number of retention cavities 45E, provided on the rotating bar 45. The hooks 65 from an example from FIGS. 3*a* and 5 are generally L-shaped, the bent part being oriented towards the shaving plane. Thus, the retention portion 45F of the retention cavities takes a shape of complementary hooks, the bent part of which is oriented away from the shaving plane.

When the cartridge 60 is inserted into the shaver head 40, the retention features 65 encounter the retention portion 45F of the rotating bar 45 and are locked by the retention portion 45F of the rotating bar 45. In the example shown on the Figures, the small hooks 65 provided on the cartridge are snap-fitted with the small hooks 45F provided in the retention cavities 45E of the rotating bar 45, and the cartridge 60 is thus locked and held in place. At that moment, the rotating bar 45 is in its neutral position. When the cartridge 60 is inserted into the shaver head 40, the ejection buttons 51 and the underlying coil springs 52 are compressed.

Once the cartridge 60 is inserted into the shaver head 40, the cartridge 60 preferably does not perform any movements with respect to the shaver head 40. The shaver head 40 is attached pivotally to the handle 20; preferably, the pivoting means 22, 41 are provided on the shaver head 40 and on the handle 20, but not on the cartridge 60.

The above described mechanism, which uses the rotating bar 45 provided on the shaver head 40 and the holder 65 provided on the cartridge 60, brings about several advantages. The only replaced component is the cartridge 60, which in itself does not hold any additional features (such as pivoting means and the like). Therefore the price of the cartridge 60 may be lowered and the manufacturing process thereof may be simplified; as the shaver head 40 and the handle 20 are not replaced, they may be manufactured as being more robust while keeping the price reasonable. Especially, the means provided to secure the pivoting attachment of the shaver head 40 to the handle 20, may be made more reliable. The holder 65 of the cartridge is snap-fitted to the complementary feature of the shaver head 40. This setting both reduces costs and maintains reliability of the attachment of the cartridge 60 to the shaver head 40. Moreover, as the mechanical parts of the rotating lock 45 are provided not facing the outside, the wear of the mechanical parts is reduced, and the lifetime of the rotating bar may be increased.

Since the shaver head 40 and the cartridge 60 are provided with guide tracks 42A and 62A, respectively, the insertion of the cartridge 60 into the shaver head 40 is simplified and the risk of wrong insertion of the cartridge 60 is lowered.

When the cartridge 60 is attached to the shaver head 40, the ejection buttons 51 and the coil springs 52 are compressed. Therefore, when the cartridge 60 is disengaged, the ejection buttons 51 and the coil springs 52 urge the cartridge away from the shaver head 40.

Figure 7A:
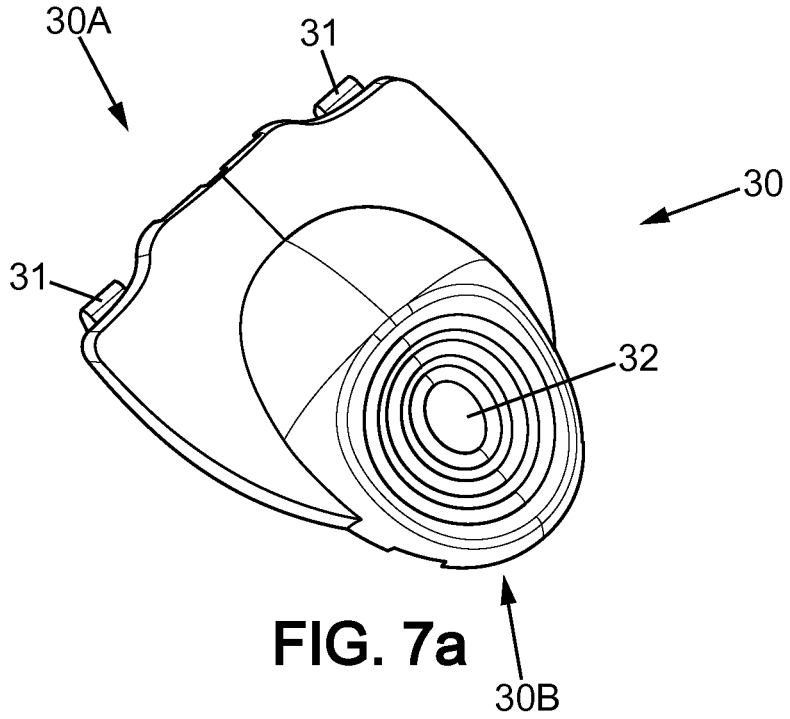
FIG. 7*a* shows a top side of a button
Figure 7B:
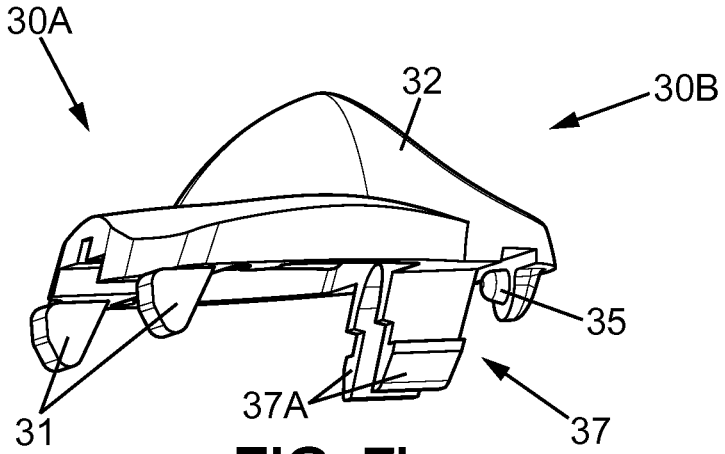
FIG. 7*b* shows an overall view of a button On the different Figures, the same reference signs designate like or similar elements.

The top part of the handle 20 adjacent the shaver head 40 is also provided with a button 30 (see FIGS. 7*a* and 7*b*). The button 30 has a front end 30A and a rear end 30B. The button 30 is slidable in a direction generally parallel to the longitudinal direction of the handle 20. To ensure sliding of the button 30, a pair of guides 37 is provided on the part of the button 30 that is adjacent to the handle 20. The guides 37 encounter the guide trails 27B provided on the front portion of the handle 20; preferably, the guides 37 are provided with a bent lower portions 37A so as to ensure that they do not disengage from the guide trails 27B. In this way, the guides 37, when in cooperation with guide trails 27B, provide the button 30 with sliding in a direction generally parallel to the length of the handle 20, prevents the button 30 from moving elsewhere, and also prevents the button 30 from disengaging from the handle 20.

The button 30 comprises a finger receiving region 32, provided on the top part of the button 30. As can be seen on FIG. 7*a*, the finger receiving region 32 may be equipped with features that help to prevent slipping of user's fingers. Once the user encounters the button 30 with his/her finger, s/he may push the button 30 in a direction towards the shaver head 40. To return the button 30 to its initial position, the button 30 is provided with a coil rest 35, which is positioned at the rear end 30B of the button 30, adjacent the handle 20. The coil rest 35 cooperates with the coil spring 36. When the button 30 is pressed by the user, the coil spring 36 is compressed, and once the button 30 is released, the coil spring 36 returns the button 30 to its original position.

The button 30 further comprises a pusher 31. The pusher 31 is located in the front end 30A of the button, adjacent the shaver head 40. The pusher 31 takes a form of at least one projection which extend from the button 30 in a direction of the shaver head 40. The number of the projections 31 preferably corresponds to the number of the projections 45A provided on the rotating bar 45. Preferably, there is a pair of projections 31. The projections 31 provided on the button 30 are preferably aligned with the projections 45A provided on the rotating bar 45.

Once the user wishes to replace the cartridge 60, s/he pushes the button 30 and the cartridge 60 is disengaged. More specifically, the projections of the pusher 31 encounter the projections 45A of the rotating bar 45. The projections 45A are moved upwards, in a direction towards the top wall 61 of the cartridge 60. The rotating bar 45 is thus rotated. Once the rotating bar 45 is rotated, the retention features 65 provided on the cartridge 60 are released from the retention cavities 45E, provided on the rotating bar 45. In the example shown on the Figures, when the rotating bar 45 is rotated, the hooks that form the retention features 65 are released from the hooks forming the retention portion 45F. When the retention features 65 are disengaged from the retention cavities 45E, the cartridge 60 is urged away from the shaver head 40 by the ejection buttons 51. The ejection buttons 51 are operated by the coil springs 51, which are compressed, when the cartridge 60 is inserted, and which urge the cartridge 60 away once it is disengaged. The axis of rotation for the rotating bar 45 is defined by the holding pegs 42B. The rotating bar 45 is then returned to its neutral position by the leaf spring 56.

In this way, the user does not have to touch the cartridge 60 by his/her fingers and the risk of cutting the user's fingers with the blades 63 is then reduced.

The invention claimed is:

1. A shaver comprising:

a handle with an elongated handgrip portion and a mounting portion, a shaver head including a pair of lateral walls spaced by a bottom part, the shaver head being attached to the mounting portion, a removable cartridge that includes at least one blade, the at least one blade having a length, the cartridge being adapted to be attached to the shaver head and removed from the shaver head, a rotating lock including an elongate body, at least one projection, a pair of cavities positioned at the ends of the elongated body and being adapted to attach the rotating lock to the shaver head, and at least one retention cavity, the rotating lock being provided on the shaver head, extending between the pair of lateral walls, and being adapted to removably attach the cartridge to the shaver head, wherein the rotating lock is adapted to rotate about an axis parallel to the length of the at least one blade, thus defining a neutral position and a rotated position, and wherein the rotating lock in the neutral position attaches the cartridge to the shaver head, and the rotating lock in the rotated position releases the cartridge from the shaver head.

2. The shaver according to claim 1, wherein the shaver head is attached pivotally to the mounting portion.

3. The shaver according to claim 1, wherein the shaver head further comprises a bottom part positioned in front of the at least one blade in the direction of shaving, and wherein the rotating lock is provided in the bottom part.

4. The shaver according to claim 1, wherein the shaver head further comprises a pair of holding pegs, and wherein the holding pegs facilitate the rotation of the rotating lock.

5. The shaver according to claim 1, wherein the cartridge is ejected in a direction parallel to the direction of shaving.

6. The shaver according to claim 1, wherein the rotating lock is a rotating bar.

7. The shaver according to claim 6, wherein the handle further comprises a slidable button, the button comprising a pusher, the pusher being adapted to encounter the at least one projection of the rotating lock and thus release the cartridge.

8. The shaver according to claim 1, wherein the shaver head further comprises a return spring, the return spring being adapted to return the rotating lock to the neutral position.

9. The shaver according to claim 1, wherein the shaver head further comprises at least one ejection button, the ejection button being adapted to eject the cartridge from the shaver head.

10. The shaver according to claim 9, wherein the shaver head further comprises at least one ejection spring, the ejection spring cooperating with the at least one ejection button.

11. The shaver according to claim 1, wherein the cartridge further comprises a holder, and wherein the retention cavities of the rotating lock and the holder cooperate to attach the cartridge to the shaver head.

12. The shaver according to claim 1, wherein the shaver head further comprises lateral walls, wherein the lateral walls comprise guide tracks, wherein the cartridge further comprises lateral walls, the lateral walls comprising guide tracks, and wherein the guide tracks of the cartridge are adapted to cooperate with guide tracks of the shaver head.

13. A cartridge to be used with a shaver according to claim 1, wherein the cartridge comprises a holder, and wherein the holder takes a form of at least one hook.

14. The cartridge according to claim 13, comprising at least one blade, wherein the at least one blade is mounted movably.

15. The cartridge according to claim 13, wherein the cartridge further comprises a top wall and a shaving aid, the shaving aid being positioned in the top wall.

16. A head and handle assembly for a shaver comprising:

a handle with an elongated handgrip portion and a mounting portion, a shaver head including an elongate body having a pair of lateral walls spaced by a bottom part, the shaver head being adapted to receive a cartridge, the shaver head being attached to the mounting portion, a rotating lock provided on the shaver head, the rotating lock extending between the pair of lateral walls and including at least one projection, a pair of cavities positioned at the ends of the elongated body and being adapted to attach the rotating lock to the shaver head, and at least one retention cavity, the rotating lock being adapted to removably attach the cartridge to the shaver head, wherein the rotating lock is adapted to rotate about an axis parallel to the length of the at least one blade, thus defining a neutral position and a rotated position, and wherein the rotating lock in the neutral position is adapted to attach the cartridge to the shaver head, and the rotating lock in the rotated position is adapted to release the cartridge from the shaver head.

17. A head and handle assembly according to claim 16, wherein the shaver head is attached pivotally to the mounting portion.

18. A head and handle assembly according to claim 16, wherein the shaver head further comprises a bottom part, and wherein the rotating lock is provided in the bottom part.

19. A head and handle assembly according to claim 16, wherein the handle further comprises a slidable button, the button including a pusher, the pusher being adapted to encounter the at least one projection of the rotating lock and thus release the cartridge.

* * * * *